US012515105B2

(12) United States Patent
Turner et al.

(10) Patent No.: US 12,515,105 B2
(45) Date of Patent: Jan. 6, 2026

(54) BALANCE TILT BOARD

(71) Applicant: Shon Turner, Falls Church, VA (US)

(72) Inventors: Shon Turner, Falls Church, VA (US); James Hurd, Arlington, VA (US); John Garry Myers, Gainesville, TX (US)

( * ) Notice: Subject to any disclaimer, the term of this patent is extended or adjusted under 35 U.S.C. 154(b) by 330 days.

(21) Appl. No.: 17/726,664

(22) Filed: Apr. 22, 2022

(65) Prior Publication Data

US 2022/0339505 A1 Oct. 27, 2022

Related U.S. Application Data

(60) Provisional application No. 63/178,236, filed on Apr. 22, 2021.

(51) Int. Cl.
*A63B 26/00* (2006.01)

(52) U.S. Cl.
CPC .... *A63B 26/003* (2013.01); *A63B 2208/0204* (2013.01); *A63B 2225/09* (2013.01)

(58) Field of Classification Search
None
See application file for complete search history.

(56) References Cited

U.S. PATENT DOCUMENTS 1,509,793 A * 9/1924 Thompson ..... A63B 21/023 482/79
3,582,066 A * 6/1971 Keryluk ..... A63B 69/18 482/146
4,185,622 A * 1/1980 Swenson ..... A61H 1/0266 601/31
4,561,649 A * 12/1985 Forsythe ..... A63B 23/08 482/121
4,629,181 A * 12/1986 Krive ..... A63B 69/18 482/901
4,693,470 A * 9/1987 Ogawa ..... A63B 21/00047 482/79
5,035,421 A * 7/1991 Scheller ..... A63B 21/023 482/79
5,431,406 A * 7/1995 Ishii ..... A63B 69/3652 473/279
5,645,516 A * 7/1997 Foster ..... A63B 23/085 482/121

(Continued)

FOREIGN PATENT DOCUMENTS

CN 101466441 A * 6/2009 ..... A63B 22/14
DE 20314582 U1 * 3/2004 ..... A63B 22/16

(Continued)

*Primary Examiner* — Shila Jalalzadeh Abyaneh
(74) *Attorney, Agent, or Firm* — Edell, Shapiro & Finnan, LLC

(57) ABSTRACT

In some aspects, the techniques described herein relate to an apparatus including: at least one foot board settable to one or more predetermined inclination angles; at least one rotating base rotatable through one or more predetermined ranges of rotation; and a stationary base, wherein the stationary base supports the at least one foot board and the at least one rotating base such that a user placing a foot on the at least one foot board can flex or extend the foot at the one or more predetermined inclination angles and can pronate or supinate the foot through the one or more predetermined ranges of rotation.

4 Claims, 20 Drawing Sheets

(56) References Cited

U.S. PATENT DOCUMENTS

| | | | | |
|---|---|---|---|---|
| 6,219,929 | B1 * | 4/2001 | Tasker | A43D 1/02 600/595 |
| 6,244,992 | B1 * | 6/2001 | James | A61H 1/0237 482/79 |
| 6,808,476 | B2 * | 10/2004 | Zagone | A63B 21/023 482/80 |
| 7,070,540 | B1 * | 7/2006 | Priester | A63B 5/16 482/148 |
| 7,364,534 | B2 * | 4/2008 | Zoller | A63B 23/08 482/79 |
| 8,435,164 | B2 * | 5/2013 | VanBuren | A63B 26/003 482/145 |
| 8,939,872 | B2 * | 1/2015 | Sprague | A63B 21/00047 482/79 |
| 9,987,518 | B1 * | 6/2018 | Stack | A63B 21/4049 |
| 10,071,287 | B2 * | 9/2018 | Dedvukaj | A63B 22/16 |
| 2003/0060338 | A1 * | 3/2003 | Sayce | A63B 69/18 482/146 |
| 2007/0219071 | A1 * | 9/2007 | Hamer | A63B 21/4015 482/79 |
| 2011/0256983 | A1 * | 10/2011 | Malack | A63B 21/4015 482/4 |
| 2011/0263398 | A1 * | 10/2011 | Klassen | A63B 21/4034 482/146 |
| 2021/0245008 | A1 * | 8/2021 | Kim | A63B 71/0054 |
| 2021/0268337 | A1 * | 9/2021 | Shoffler | A63B 26/003 |

FOREIGN PATENT DOCUMENTS

| | | | | | |
|---|---|---|---|---|---|
| DE | 102004006731 | B3 | * | 9/2005 | A63B 22/18 |
| EP | 1284152 | B1 | * | 5/2007 | A63B 22/16 |
| JP | 2002200194 | A | * | 7/2002 | |
| KR | 20060100018 | A | * | 9/2006 | A63B 22/14 |
| KR | 20160073705 | A | * | 6/2016 | A63B 26/003 |

* cited by examiner

100

BALANCE TILT BOARD

CROSS REFERENCE TO RELATED APPLICATIONS

This application claims the benefit of U.S. Provisional Application No. 63/178,236, filed Apr. 22, 2021, the contents of which are hereby incorporated by reference in their entirety.

TECHNICAL FIELD

The present disclosure relates to physical therapy and apparatuses used in physical therapy.

BACKGROUND

Slant boards allow for fitness training using specific angles of inclination. These angle provide a surface on which a user's foot can flex or extended at the specific angles of inclination. Related art slant boards present two settings or maybe three settings for the angle of inclination. These units have a lifespan of about 3 to 5 years in a typical setting. The most common issues with related art slant boards may include loose assembly and overall failure of the product, which becomes a safety issue and a potential liability.

DESCRIPTION OF EXAMPLE EMBODIMENTS

Overview

In some aspects, the techniques described herein relate to an apparatus including: at least one foot board settable to one or more predetermined inclination angles; at least one rotating base rotatable through one or more predetermined ranges of rotation; and a stationary base, wherein the stationary base supports the at least one foot board and the at least one rotating base such that a user placing a foot on the at least one foot board can flex or extend the foot at the one or more predetermined inclination angles and can pronate or supinate the foot through the one or more predetermined ranges of rotation.

In other aspects, the techniques described herein relate to an apparatus including: at least one foot board settable to one or more predetermined inclination angles; and a stationary base, wherein the stationary base supports the at least one foot board such that a user placing a foot on the at least one foot board can flex or extend the foot at the one or more predetermined inclination angles.

Example Embodiments

With reference now made to FIGS. 1-4, depicted therein is a first embodiment according to the techniques of the present disclosure for providing a balance tilt board.

Figure 1:
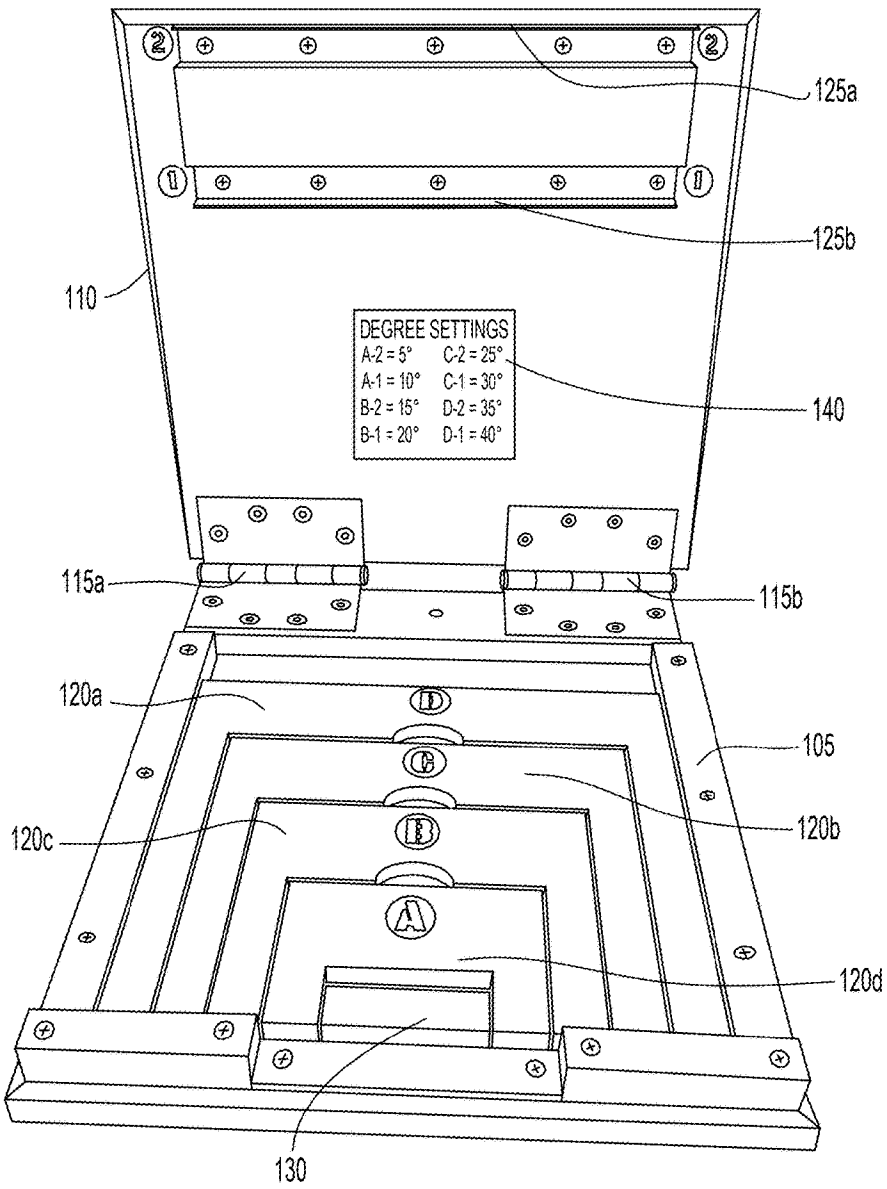
FIG. 1 illustrates a first example embodiment of a balance tilt board, according to the techniques of the present disclosure.

The balance tilt board 100 illustrated in FIG. 1 may provide one or more of the following non-exhaustive list of features and benefits:

- Static and dynamic stretching of gastrocnemius, soleus, and/or hamstring muscles.
- A number of different angled measurements (e.g., 0-40 degrees) of inclination for user foot flex and extension, allowing the users flex and extension to progress and regress according to needs of user.

Promotion of proper ankle-knee-hip-shoulder alignment.

Aid in plantar fascia stretching, including flexion and extension stretching.

Aid in Achilles' tendon stretching, including flexion and extension stretching.

Balance tilt board 100 includes a base 105 and a foot board 110 connected to base 105 via one or more hinges 115*a* and 115*b*. Hinges 115*a* and 115*b* allow for changes in the pitch (illustrated as angle Θ in FIG. 2) of foot board 110 relative to base 105. Also included in balance tilt board 100 are nested supports 120*a-d* and gussets 125*a* and 125*b*. As shown in FIG. 1, supports 120*a-d* are arranged in a nested fashion on base 105, and are connected to base 105 via shared hinge 130. Each of nested supports 120*a-d* may be rotated about shared hinge 130 to engage with one of gussets 125*a* or 125*b* to maintain foot board 110 at a predetermined pitch, as illustrated in FIGS. 2-4.

Figure 2:
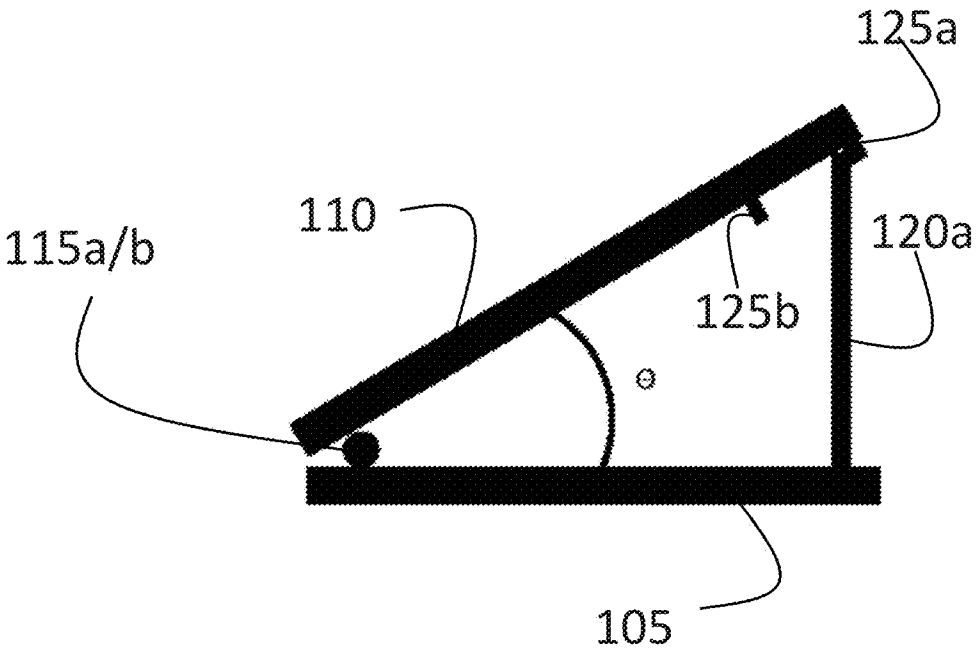
FIG. 2 illustrates a side view of an incline adjustment mechanism of the first example embodiment balance tilt board in a first position, according to the techniques of the present disclosure.
Figure 3:
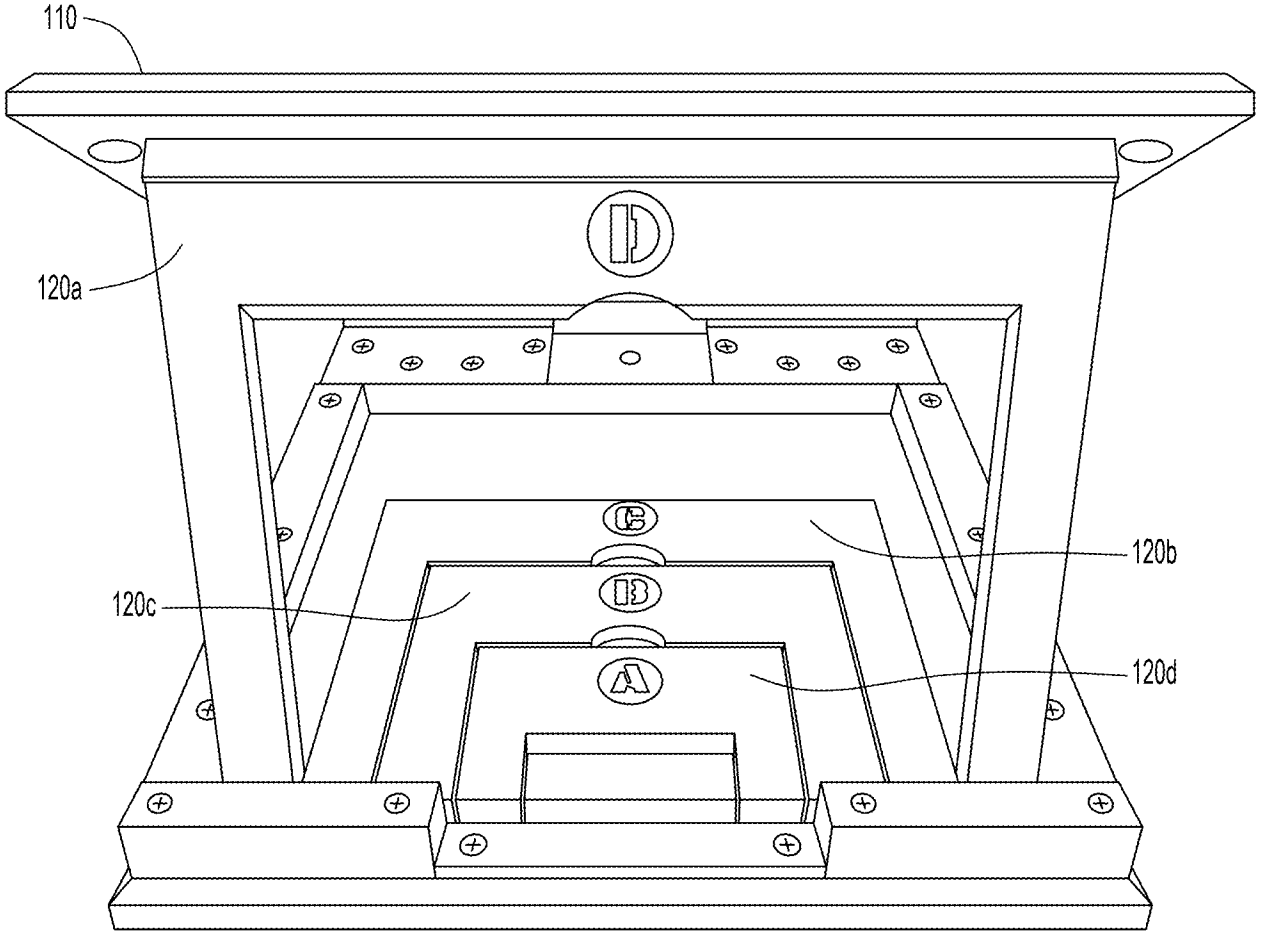
FIG. 3 illustrates a back view of an incline adjustment mechanism of the first example embodiment balance tilt board, according to the techniques of the present disclosure.
Figure 4:
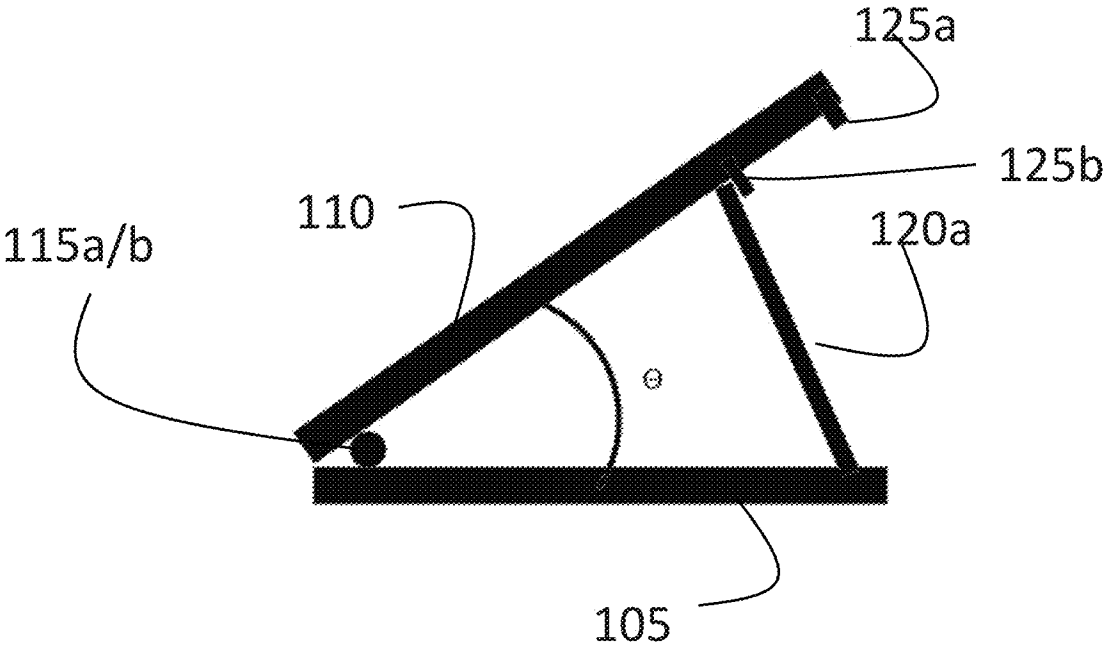
FIG. 4 illustrates a side view of an incline adjustment mechanism of the first example embodiment balance tilt board in a second position, according to the techniques of the present disclosure.

FIGS. 2 and 3 show support 120*a* engaging with gusset 125*a* to maintain foot board 110 at a first pitch. FIG. 4 shows support 120*a* engaging with gusset 125*b* to maintain foot board 110 at a second pitch greater than the first pitch of FIGS. 2 and 3. Because balance tilt board 100 includes four nested supports 120*a-d* and two gussets 125*a* and 125*b*, foot board 110 may be arranged at 9 predetermined pitches: a first pitch at which none of nested supports 120*a-d* are engaged with either of gussets 125*a* and 125*b*, four pitches corresponding to each of nested supports 120*a-d* engaging with gusset 125*a*, and four pitches corresponding to each of nested supports 120*a-d* engaging with gusset 120*b*. By including additional or fewer nested supports and/or additional or fewer gussets, balance tilt board 100 may be configured such that foot board 110 may be maintained at a greater or fewer number of predetermined pitches.

A balance tilt board like that illustrated in FIGS. 1-4 may include the following key features:

Defined angles for movement determined using predetermined heights for supports 120*a-d* and/or locations for gussets 125*a* and 125*b*.

Figure 5:
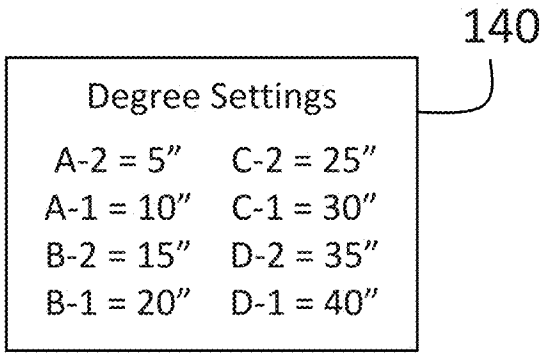
FIG. 5 illustrates a height setting guide included on the first example embodiment balance tilt board, according to the techniques of the present disclosure.

A chart setting guide 140 included on balance tilt board 100 (see also FIG. 5).

Letter and number combinations on setting guide 140 to make it easy to confirm the amount of incline of foot board 110 in set increments (see also FIG. 5).

Heavy-duty construction using Oak, Aluminum, Steel. Stainless Steel, Corrosion Resistant Steel, 3D printed composites, and other materials known to the skilled artisan.

Contact friction beds to prevent slipping between supports 120*a-d* and gussets 125*a* and 125*b*.

A bright visual line to help with initial body alignment per foot when stepping on the unit.

Figure 6:
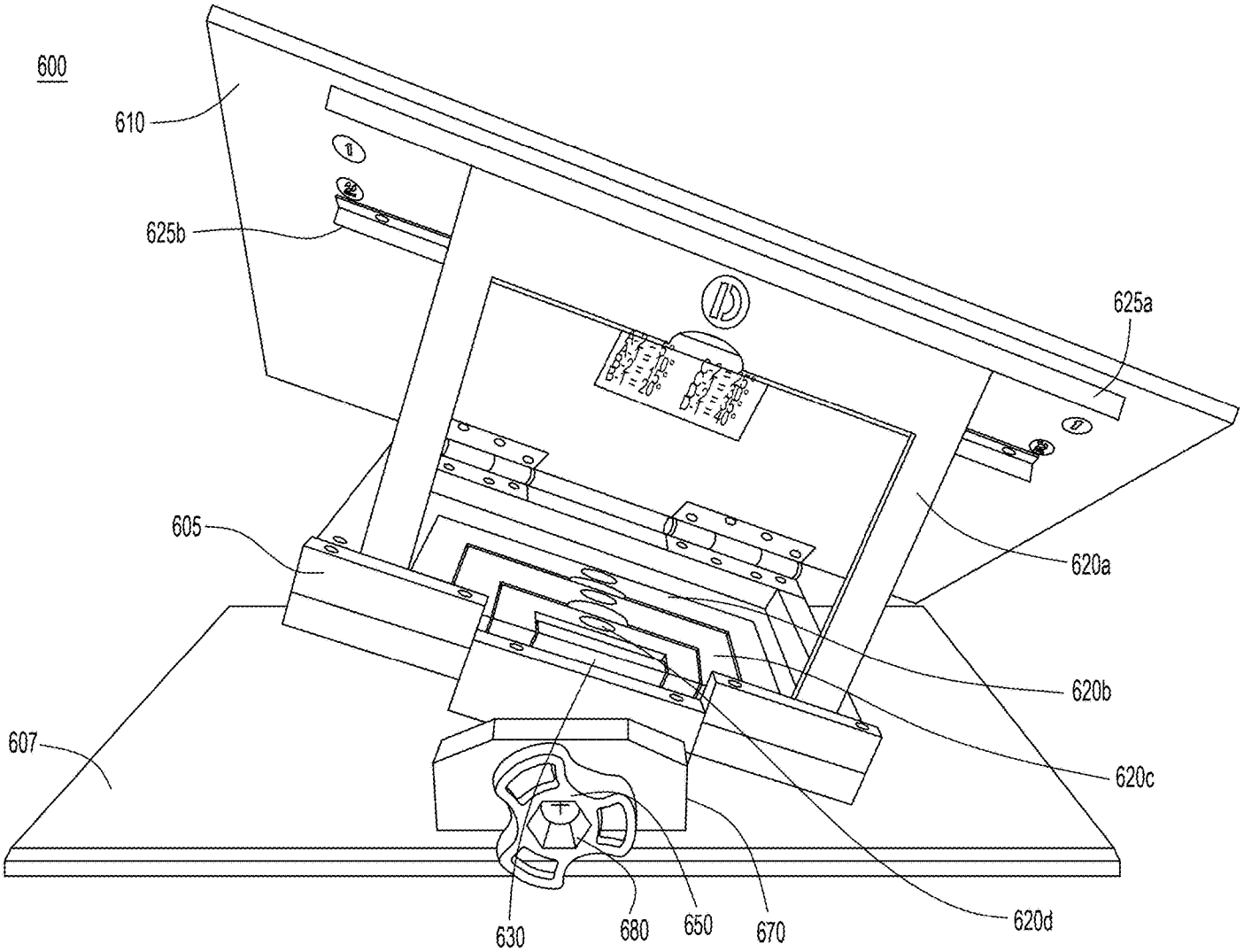
FIG. 6 illustrates a second example embodiment of a balance tilt board, according to the techniques of the present disclosure.

With reference now made to FIG. 6, depicted therein is a second embodiment balance tilt board 600 according to the techniques of the present disclosure that provides for both slant and tilt.

The balance tilt board 600 illustrated in FIG. 6 may provide one or more of the above-described features and benefits of balance tilt board 100 of FIG. 1. Balance tilt board 600 may also provide one or more of the following additional features and benefits:

Improved user balance and coordination.

Stronger user lower leg muscles, especially the peroneal muscles.

Increased user motor skills.

Injury prevention, especially for user ankles.

Help with user injury rehabilitation.

Improved user posture.

Improved user vestibular processing.

Improved user core strength.

Improved user mind muscle connection.

Improve user athletic performance.

Progressively challenging range of motion angles, including foot, flexion, extension, pronation and supination range of motion angles.

Specifically, balance tilt board 600 includes a rotating base 605, a stationary base 607 and foot board 610. Foot board 610 is connected to rotating base 605 via one or more hinges (analogous to how foot board 110 is connected to base 105 of FIG. 1 via hinges 115*a* and 115*b*) which allow for the pitch of foot board 610 relative to rotating base 605 to be changed. Also included in balance tilt board 600 are nested supports 620*a-d* and gussets 625*a* and 625*b*. Similar to supports 120*a-d* of FIG. 1, supports 620*a-d* are arranged in a nested fashion on rotating base 605, and connect to rotating base 605 via shared hinge 630. As illustrated in FIG. 6, each of nested supports 620*a-d* may be rotated about shared hinge 630 to engage with one of gussets 625*a* or 625*b* to maintain foot board 610 at a predetermined pitch or inclination, similar to how nested supports 120*a-d* may be rotated about shared hinge 130 to engage with one of gussets 125*a* or 125*b* to maintain foot board 110 at a predetermined pitch or inclination, as illustrated in FIGS. 2-4.

Figure 7:
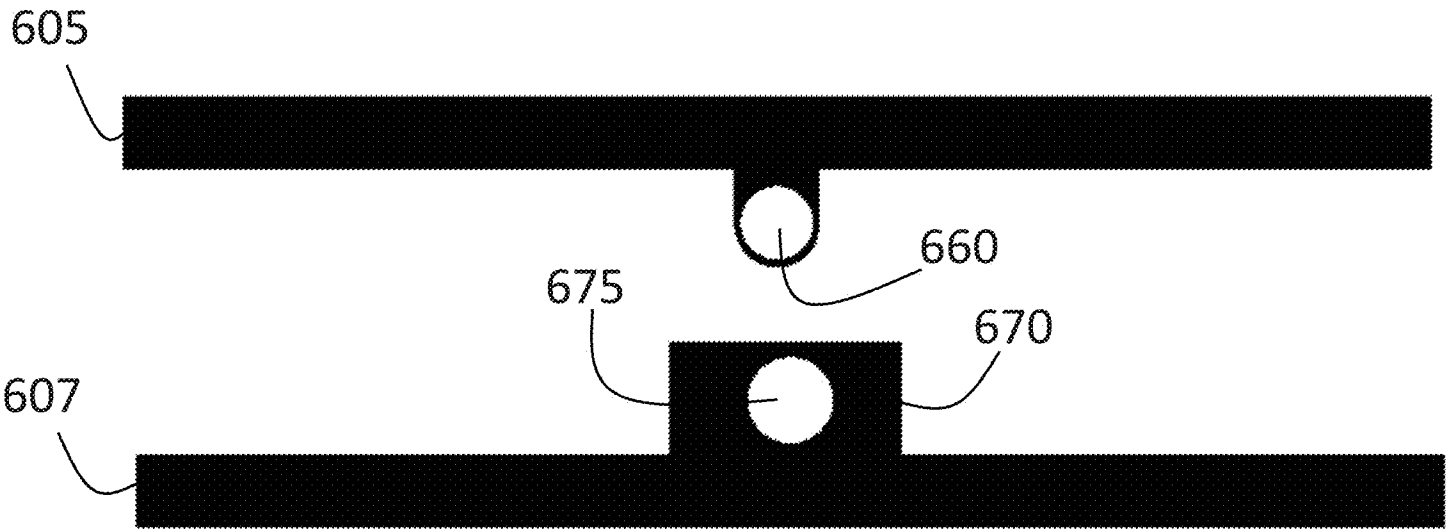
FIG. 7 is an exploded view of a rotation mechanism of the second example embodiment balance tilt board, according to the techniques of the present disclosure.
Figure 8:
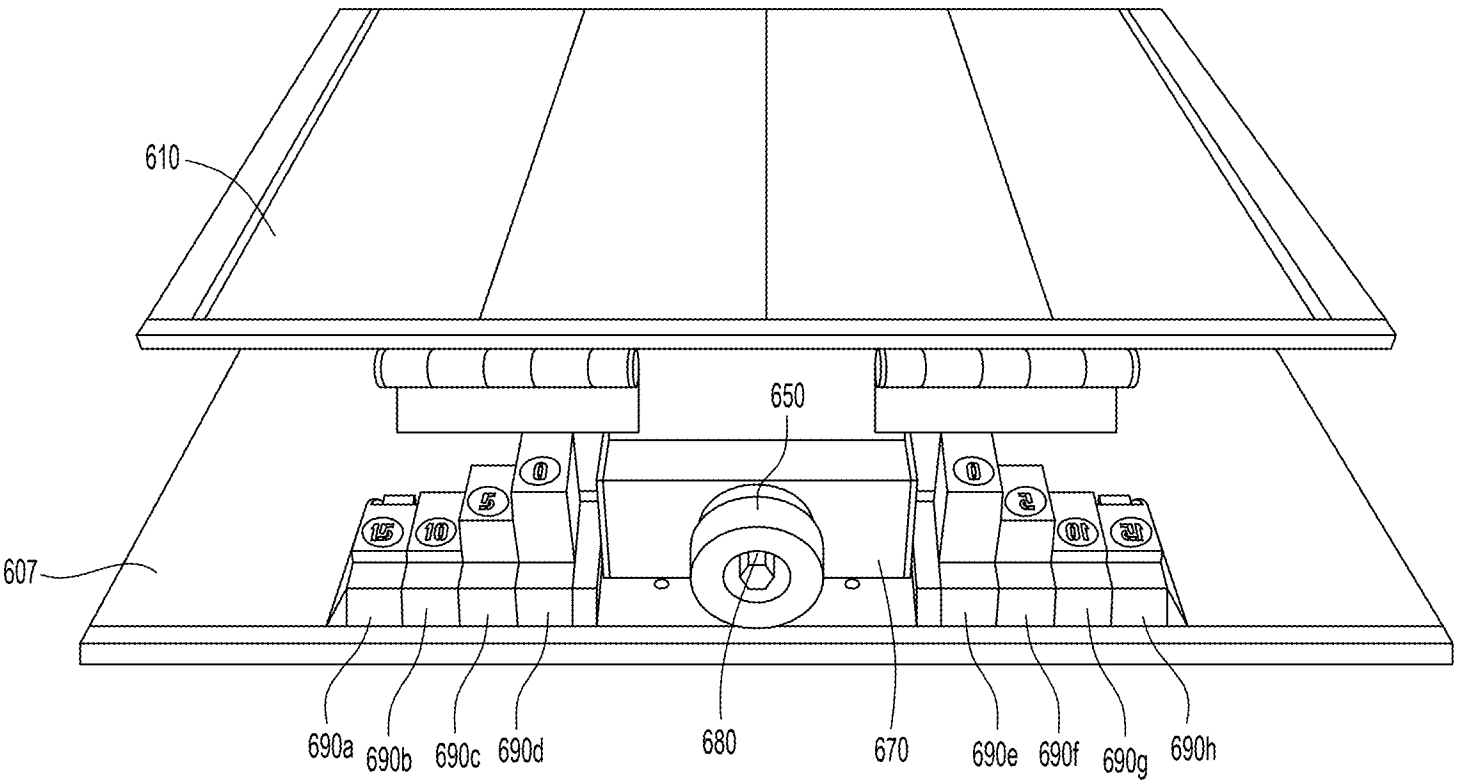
FIG. 8 is a first illustration of a mechanism configured to set a range of motion of the second example embodiment balance tilt board, according to the techniques of the present disclosure.
Figure 9:
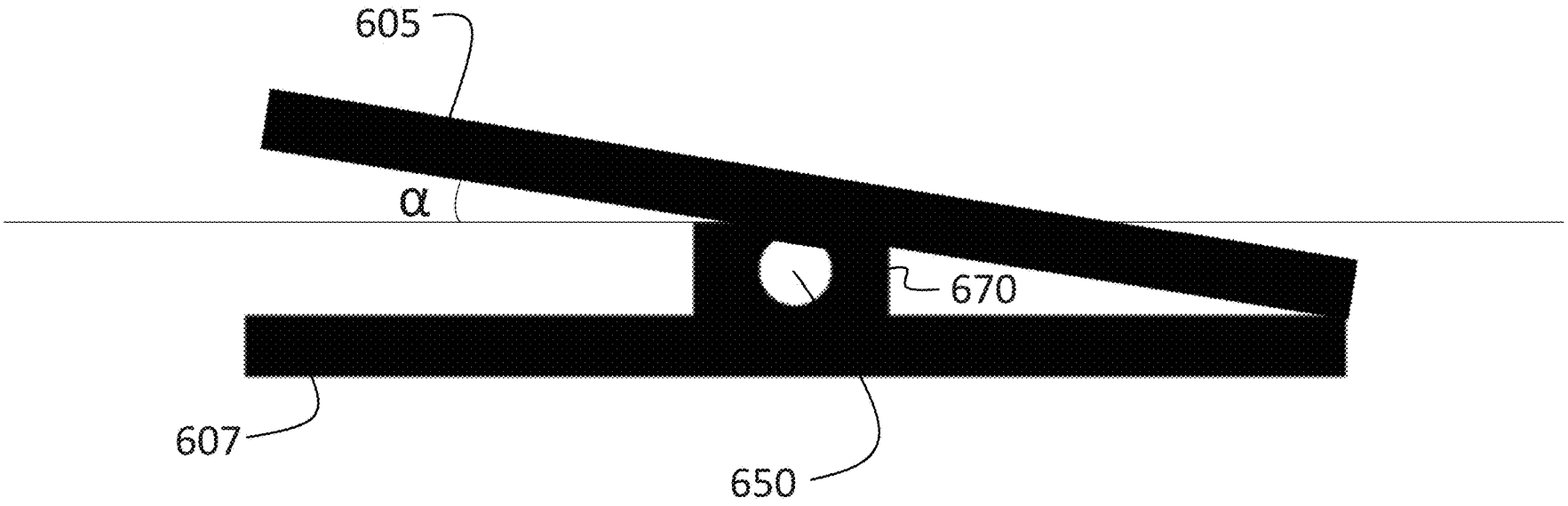
FIG. 9 illustrates the range of motion provided by a rotation mechanism of the second example embodiment balance tilt board, according to the techniques of the present disclosure.

Rotating base 605 is itself mounted to stationary base 607 via fulcrum 650. According to the specific embodiment of FIG. 6, fulcrum 650 is constructed as illustrated in FIG. 7. Specifically, the bottom of rotating base 605 is formed with a conduit 660. Stationary base 607 is formed with supports 670, one of which is illustrated in FIG. 8. The supports 670 include an orifice 675. Conduit 660 is aligned with the orifice 675 included in supports 670. A resilient rod, such as a steel rod, is inserted through orifice 675 arranged in the first support 670, through conduit 660, and through the orifice 675 in a second support 670. The rod is then held in place with endcaps 680, illustrated in FIG. 6. With this rod in place and secured by endcaps 680, rotating base 605 may rotate or pivot about the fulcrum 650 relative to the stationary base 607. Depending on the height of supports 670 and conduit 660, rotating base 605 may rotate a predetermined angle α to either side of the fulcrum 650, for a full range of rotation of two times a, as illustrated in FIG. 9.

Figure 10:
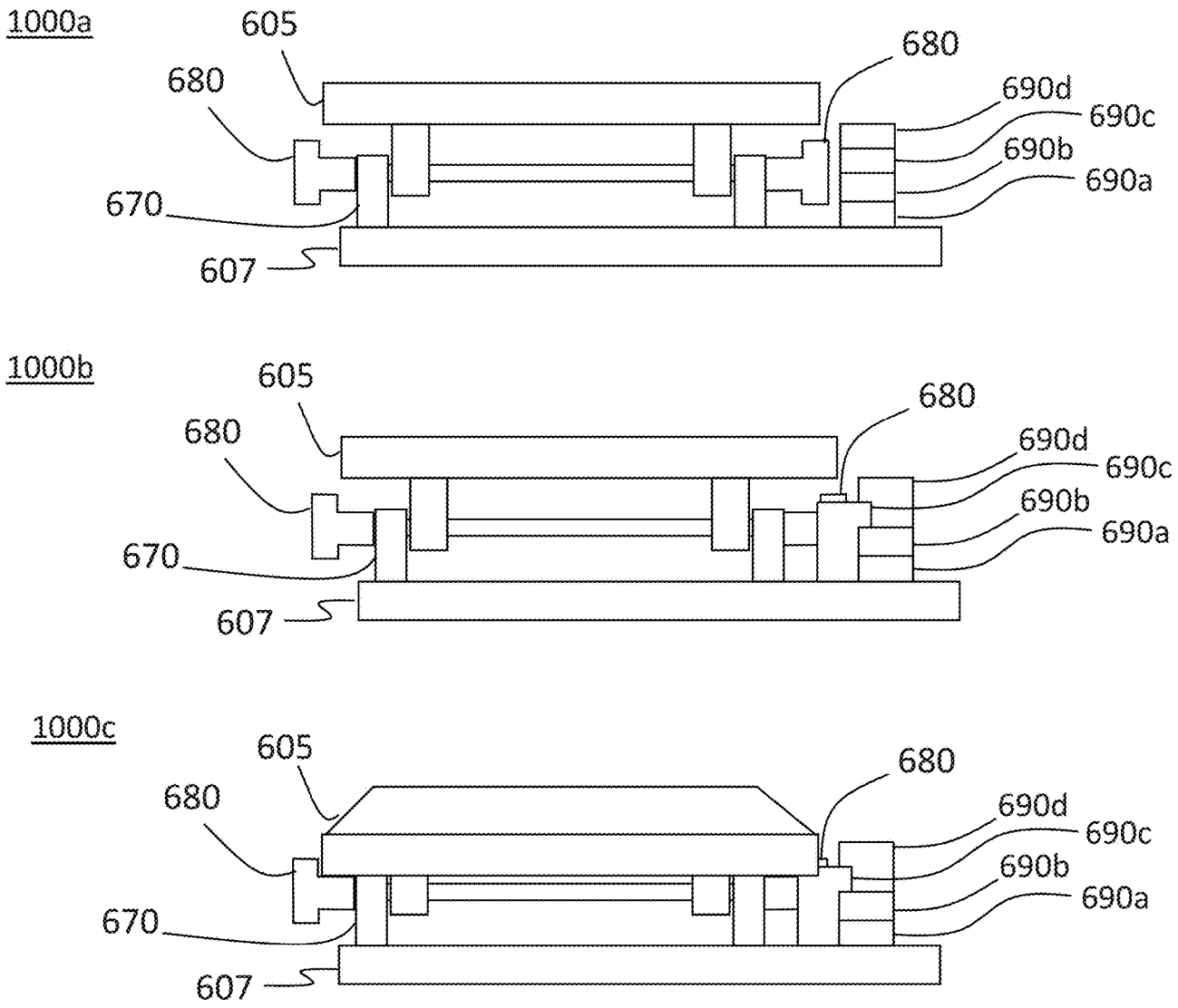
FIG. 10 is a series of images illustrating how a range of motion of the second example embodiment balance tilt board is set, according to the techniques of the present disclosure.

Depending on the use of balance tilt board 600, it may be desirable to have a small range of rotation to one or both sides of the fulcrum 650. Accordingly, as illustrated in FIG. 8, balance tilt board 600 includes blocks 690*a-h*. Blocks 690*a-h* are configured to slide under rotating base 605 to restrict the amount of rotation that rotating base 605 may provide about fulcrum 650. For example, as illustrated in the progression of images 1000*a-c* of FIG. 10, one of blocks 690*a-h* may be slid underneath rotating base 605 to restrict its range of motion. Specifically, as illustrated in the progression of image 1000*a* to image 1000*b*, block 690*c* slides underneath rotating base 605. As illustrated in the progression of image 1000*b* to image 1000*c*, as rotating base 605 rotates towards block 690*c*, rotating base 605 will contact block 690*c*, preventing further rotation of rotating base 605.

Figure 11:
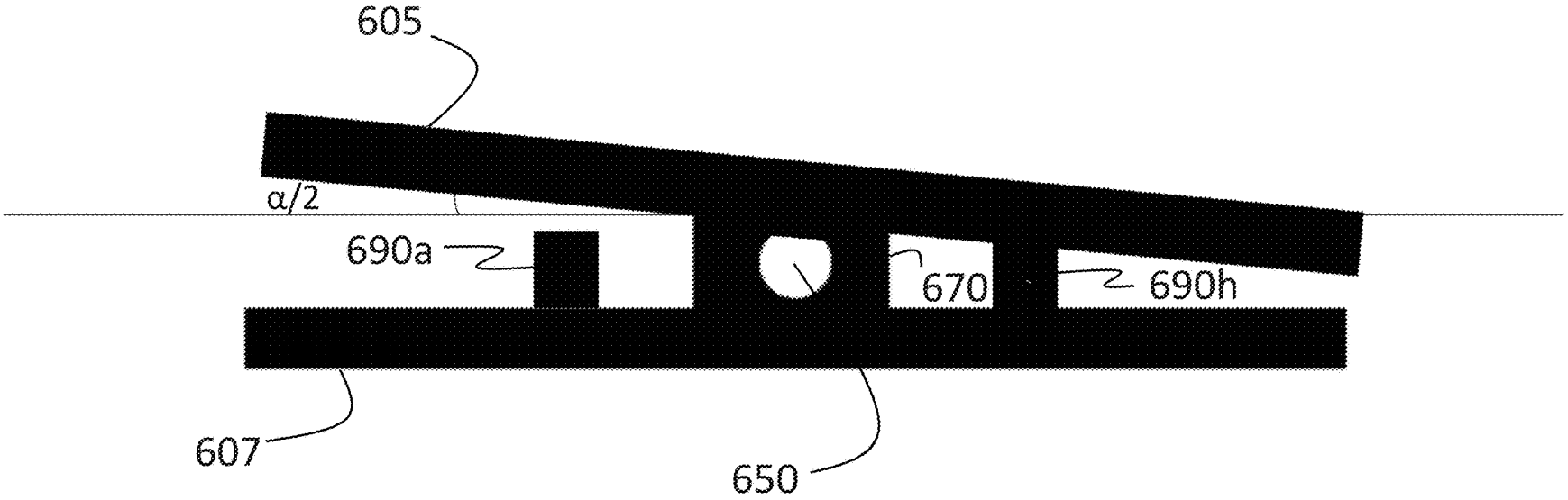
FIG. 11 illustrates how a rotation mechanism alters the range of motion of the second example embodiment balance tilt board, according to the techniques of the present disclosure.

As a further example, blocks 690*a* and 690*h* restrict the motion of rotating base 605 by half, as illustrated in FIG. 11. While FIG. 11 shows blocks of equal height being slid under rotating base 605, blocks of different heights may be slid under different sides of rotating base 605 to provide for different ranges of motion to each side of fulcrum 650.

In summary, the example embodiments described in FIGS. 6-11 provide for a multitude of uses and may provide any Physical Therapist or Fitness Trainer with a wealth of options in a standardized system which meets the critical requirements of both environments. Key features of such example embodiments may include:

- Defined inclination and rotation angles for user foot movement with a chart setting guide.
- Rotation of rotating bases 605 for each side of, for example, 15 degrees inward and outward.
- A letter & number combination guide to facilitate the setting of the incline and rotation angles in set increments.
- A robust construction that may handle over 350 pounds of continuous load.
- A colored and numbered system for blocks 690*a-g* to limit rotation side to side in set increments.
- Indicators on inclination and rotation to verify angles of settings.
- A heavy-duty construction using Oak, Aluminum, Steel. Stainless Steel, Corrosion Resistant Steel, 3D printed composites, and others known to the skilled artisan.
- A color-coded system for quick verification of settings.
- Contact friction beds to prevent slipping.
- A bright visual line to help with initial body alignment per foot when stepping on the unit.

Figure 12:
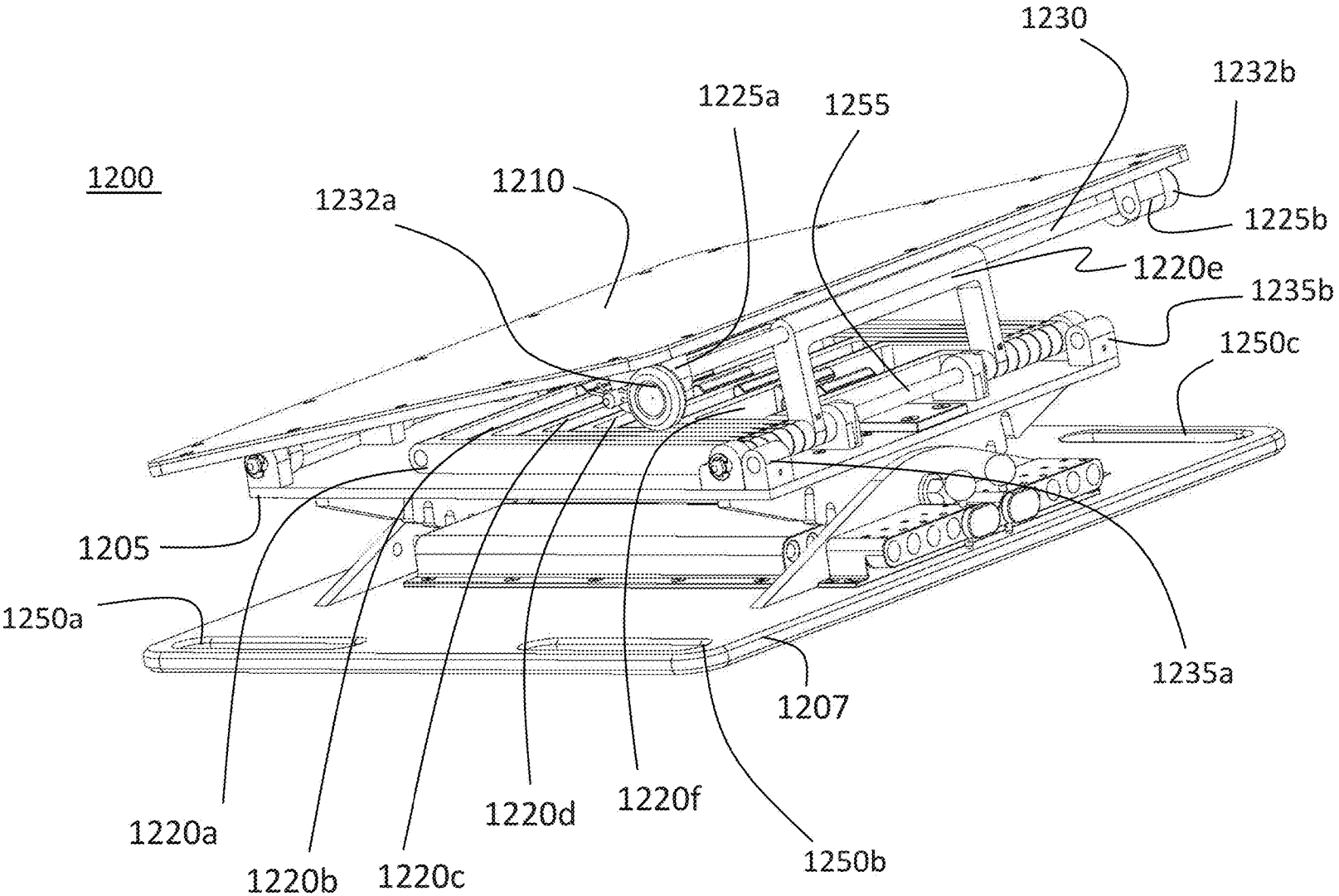
FIG. 12 is a perspective view of a third example embodiment of a balance tilt board, according to the techniques of the present disclosure.

With reference now made to FIG. 12, depicted therein is an alternative construction of a balance tilt board 1200. Like balance tilt board 600 of FIG. 6, balance tilt board 1200 provides both tilt and rotation. Balance tilt board 1200 differs from balance tilt board 600 in how the incline of foot board 1210 is set and in how the range of motion of rotating base 1205 relative to stationary base 1207 is set.

Like foot board 610, the pitch of foot board 1210 is set by nested supports, in this case nested supports 1220*a-f*. Unlike foot board 610, nested supports 1220*a-f* are not maintained by gravity/friction against gussets of foot board 1210. Instead supports 1220*a-f* are secured to gussets 1225*a* and 1225*b* by connecting rod 1230. Connecting rod 1230, which may be constructed from solid metal, may be secured in place with cotter pins 1232*a* and 1232*b*, or through other means known to the skilled artisan. The home position/horizontal angle zero of top plate 1210 is also secured in place with the same connecting rod 1230, cotter pins 1232*a* and 1232*b* and gussets 1235*a* and 1235*b*. Cotter pins 1232*a* and 1232*b* may have an ergonomically shaped cushioned gripping button for comfortable contact and handling. The gussets 1225*a* and 1225*b* and gussets 1235*a* and 1235*b* may be secured in their individual home positions with a unique component designed and fabricated for this purpose. The pivot axis 1255 of the nested supports 1220*a-f* may also be constructed of a solid metal rod.

Figure 13:
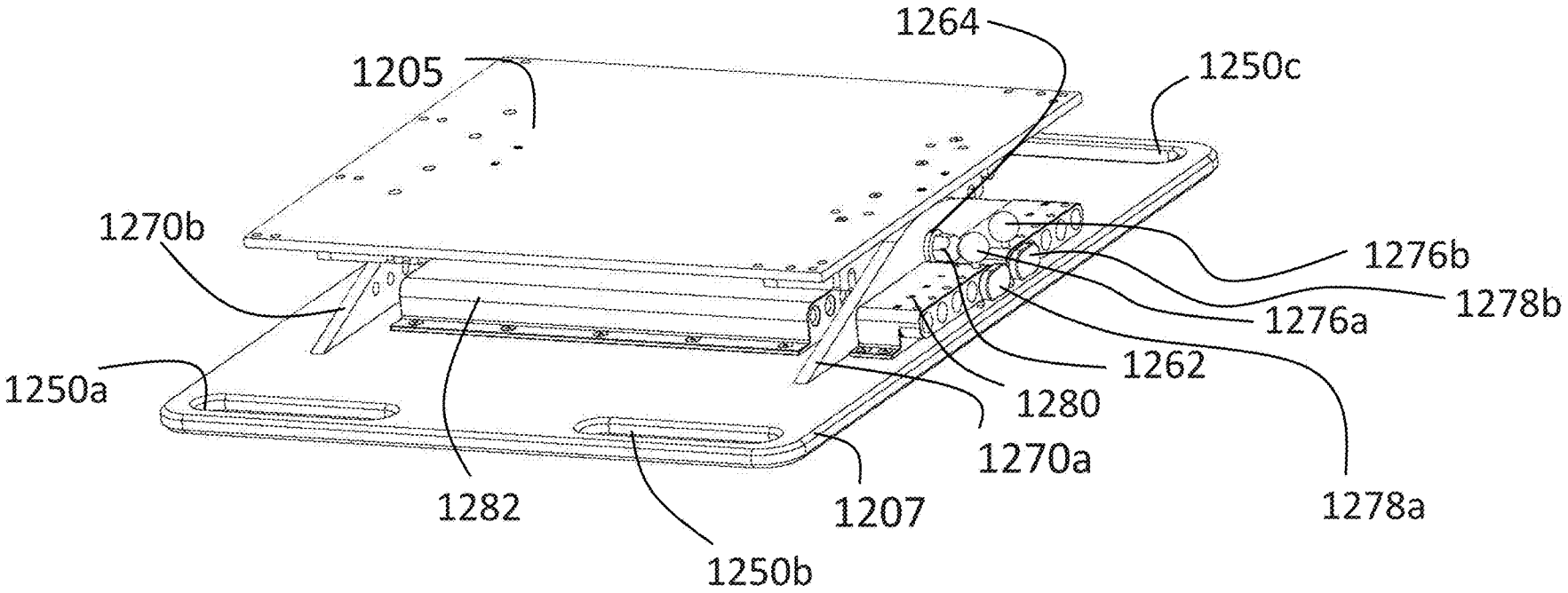
FIG. 13 is a perspective view of a rotation mechanism of the third example embodiment of a balance tilt board, according to the techniques of the present disclosure.
Figure 14:
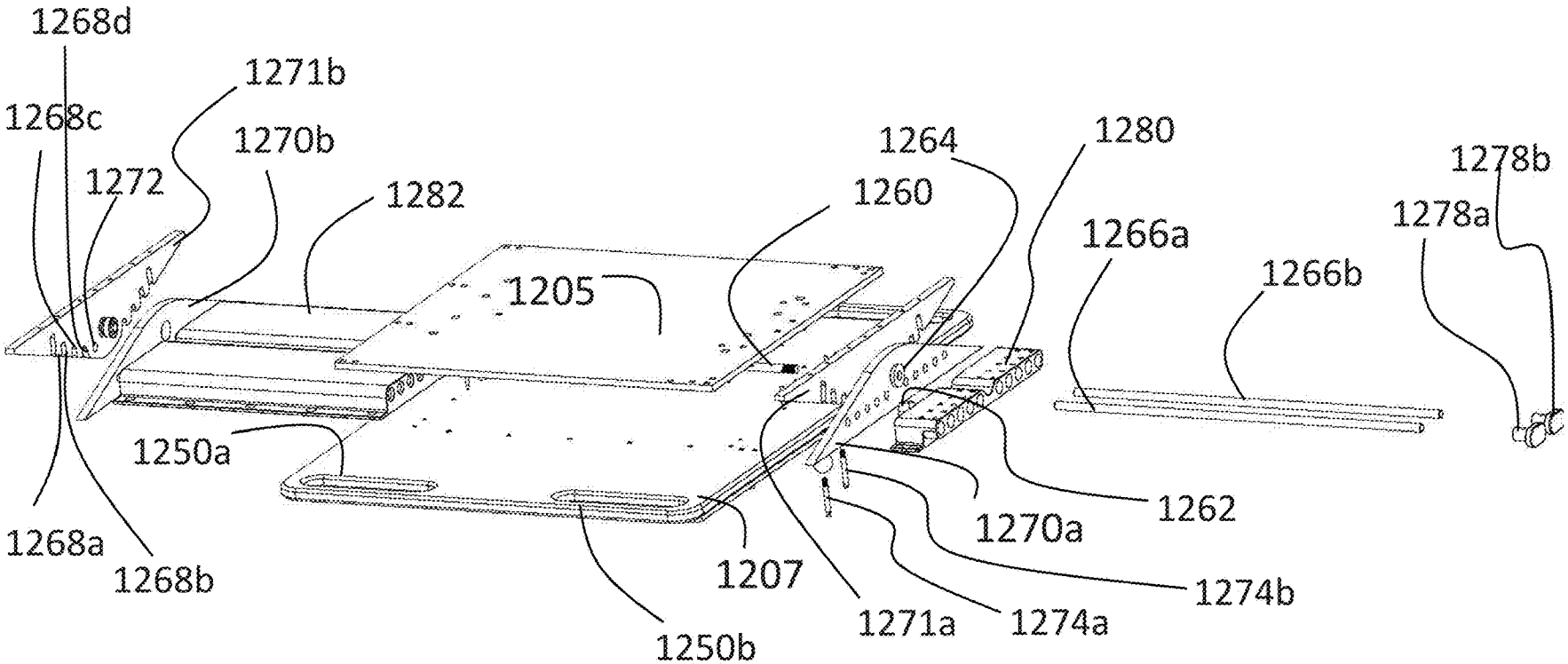
FIG. 14 is an exploded view of a rotation mechanism of the third example embodiment of a balance tilt board, according to the techniques of the present disclosure.

With reference now made to FIGS. 13 and 14 (which illustrate the stationary base 1207 and rotating base 1205 in assembled and exploded views, respectively), the rotation mechanism for rotating base 1205 will now be described. The rotation of rotating base 1205 relative to stationary base 1207 is about axis 1260, which is threaded on its ends and held in place by nut 1262 against washer 1264 and lower stop plate 1270*a*. Limits of motion (stops) are set by metal rods 1266*a* and 1266*b* which pass through lower stop plate 1270*a*, span the entire axis 1260, and pass through lower stop plate 1270*b*. Metal rods 1266*a* and 1266*b* engage with notches 1268*a-h* or hole 1272 (or a corresponding hole formed in upper stop plate 1271*a/b* on the opposite side of axis 1260 (not pictured)) in upper stop plates 1271*a* and 1271*b*. When metal rods 1266*a* and 1266*b* engage with notches 1268*a-h*, rotating base 1205 will be allowed to rotate through an angle determined by which of notches 1268*a-h* are engaged by metal rods 1266*a* and 1266*b*. Rotating base 1205 is prevented from rotating when metal rods 1266*a* and 1266*b* engage with hole 1272 (or a corresponding hole formed in upper stop plate 1271*a/b* on the opposite side of axis 1260 (not pictured)). Metal rods 1266*a* and 1266*b* are locked in place by pins 1274*a* and 1274*b*, which are then held in place by ball mechanisms 1276*a* and 1276*b*. The metal rods 1266*a* and 1266*b* also include handles 1278*a* and 1278*b* which secure the rods at each location in the direction of axis 1260. Axis 1260 and metal rods 1266*a* and 1266*b* pass through bushings 1280 and 1282, which provide for smooth rotation about axis 1260 and provide guides when changing the placement of metal rods 1266*a* and 1266*b*.

As also illustrated in FIG. 12-14, balance tilt board 1200 includes handles 1250*a-c* for easy of carrying.

With reference now made to FIGS. 14-20, depicted therein is another example embodiment according to the techniques of the present disclosure that provides for independent slant and tilt for each foot/leg of the user.

The balance tilt board illustrated in FIGS. 15-20 may provide one or more of the features and benefits described above with reference to balance tilt board 100 of FIG. 1, balance tilt board 600 of FIG. 6, and/or balance tilt board 1200 of FIG. 12. The balance tilt board illustrated in FIGS. 15-20 may also provide one or more of the following additional features and benefits:

- The ability to train specific ankle pronation and supination while in various plantar and dorsi flexed angles.
- Uni- or bilateral leg training.
- Adjustability for limitations of asymmetrical dysfunction.
- Promotion of uni- and bilateral ankle, leg, and hip function.

As illustrated in FIGS. 15-20, the construction of balance tilt board 1500 is similar to that of the embodiment illustrated in FIGS. 6-14. The difference in balance tilt board 1500 is that a single stationary base 1507 is configured with two foot boards 1510*a* and 1510*b*, two rotating bases 1505*a* and 1505*b*, and two fulcrums 1550*a* and 1550*b*. Each of the rotating bases 1505*a*/1505*b* is provided with its own set of supports 1520*a-g*, gussets 1525*a* and 1525*b* and blocks 1590*a-x*, that allow the slant and tilt for each of the rotating bases 1505*a*/1505*b* to be set independently for each foot of the user.

Figure 16:
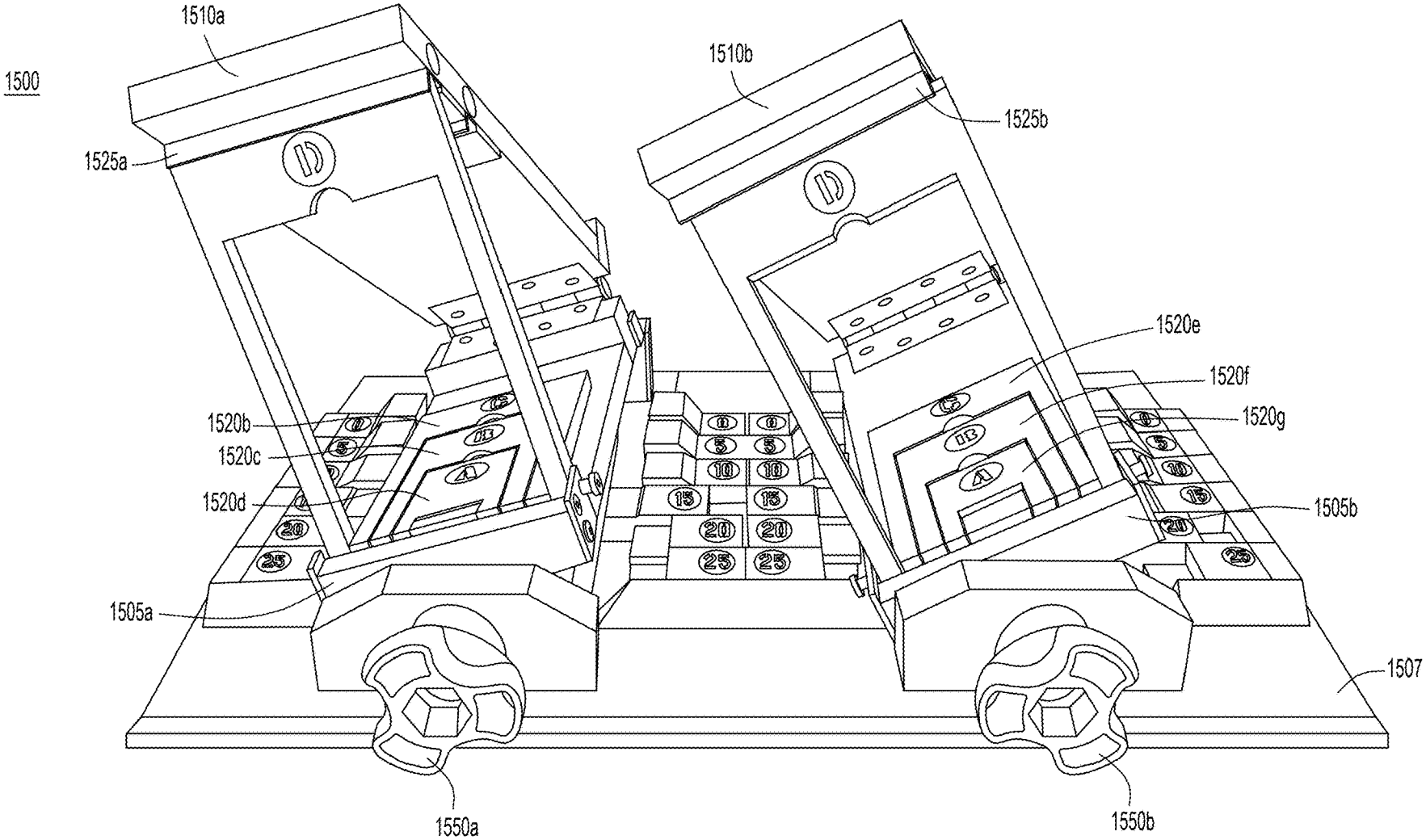
FIG. 16 is a second illustration of the fourth example embodiment of a balance tilt board, according to the techniques of the present disclosure.
Figure 17:
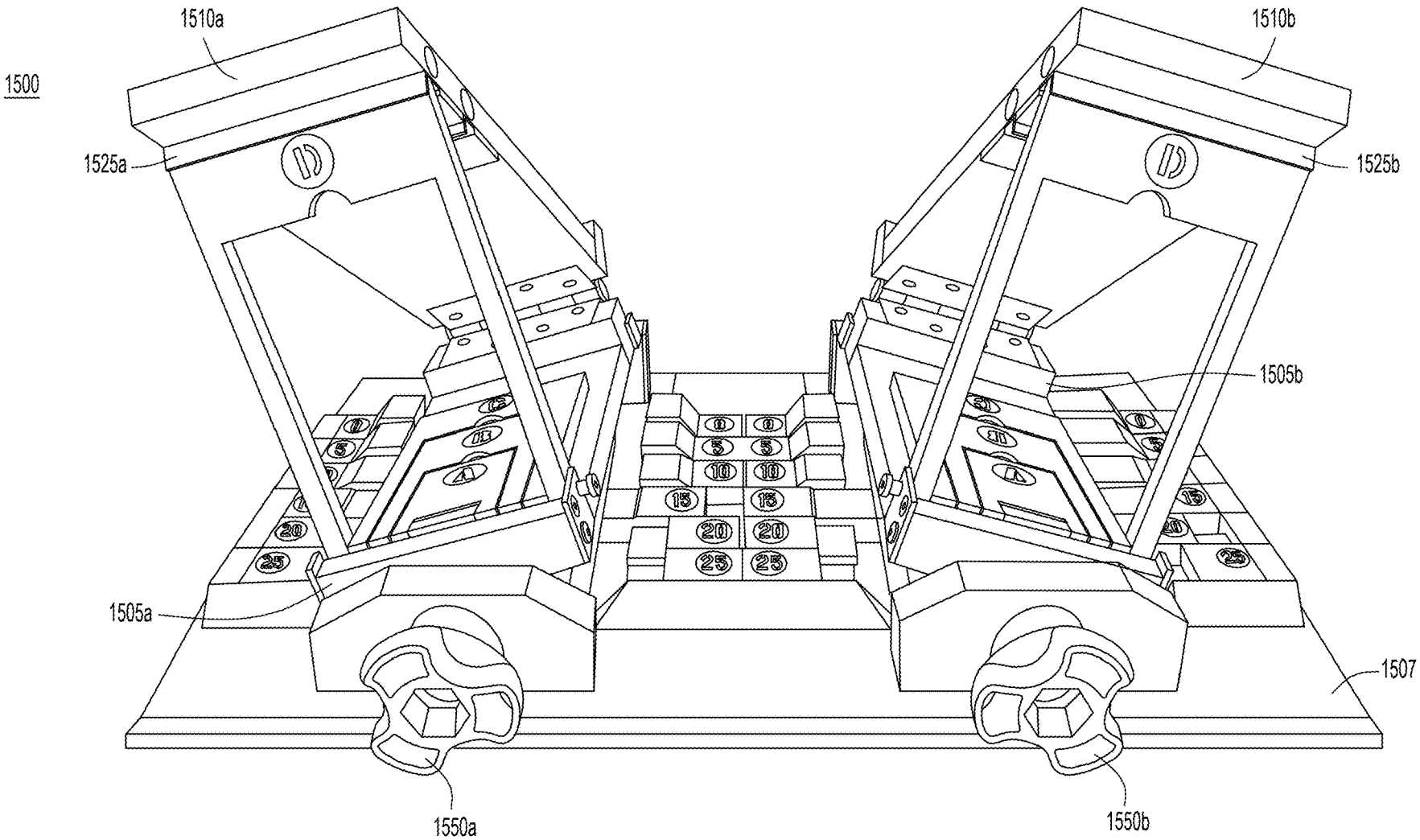
FIG. 17 is a third illustration of the fourth example embodiment of a balance tilt board, according to the techniques of the present disclosure.

For example, as illustrated through a comparison of FIGS. 16 and 17, it can be seen that foot boards 1510*a* and 1510*b* may rotate independently of each other. Similarly, because each of foot boards 1510*a* and 1510*b* is provided with its own supports and gussets (supports 1520*a-c* and gusset 1525*a* for foot board 1510*a* and supports 1520*d-g* and gusset 1525*b* for foot board 1510*b*), the inclines of foot boards 1510*a* and 1510*b* may also be set independently from each other.

Figure 18:
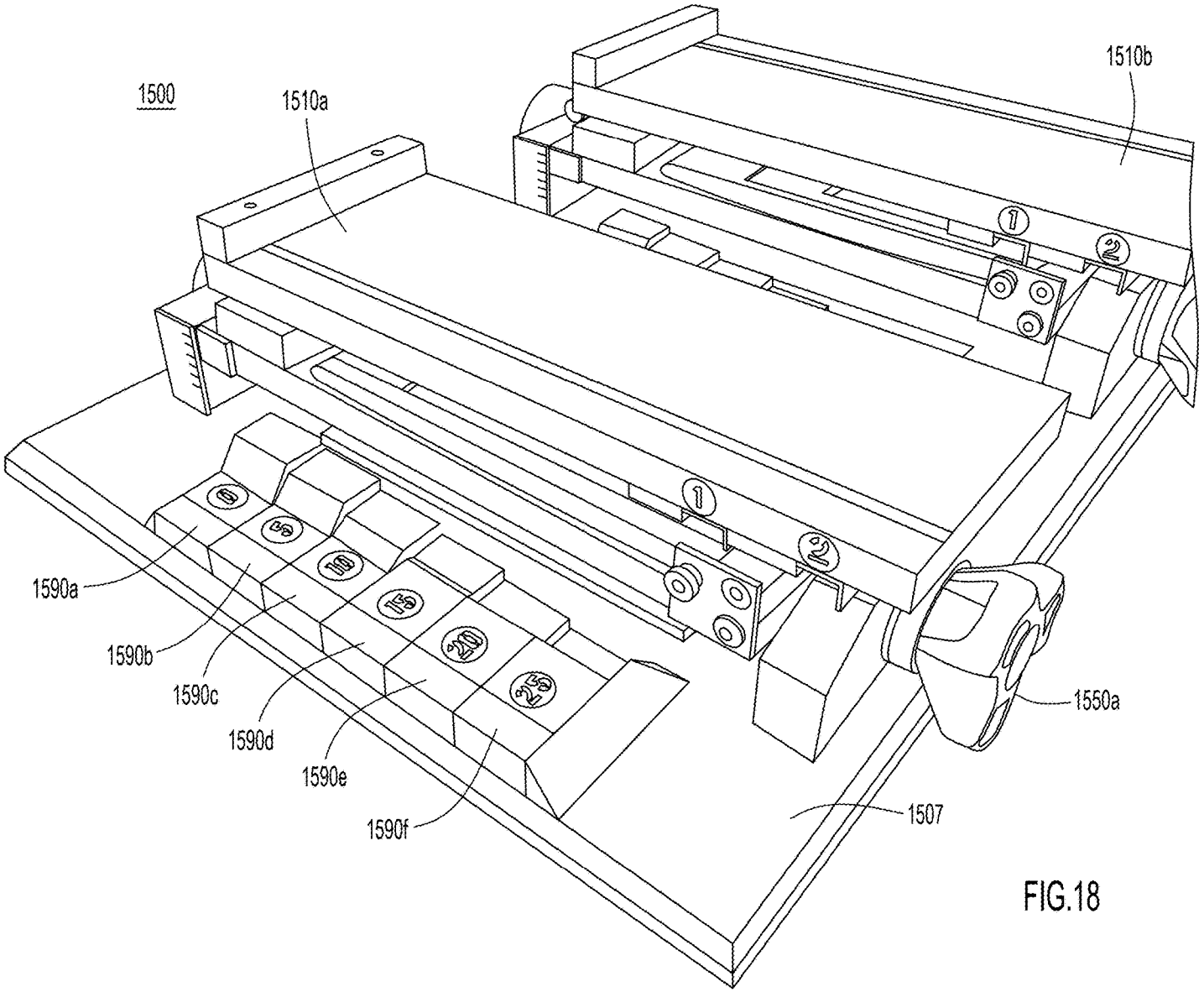
FIG. 18 is a first illustration of how a rotation mechanism alters the range of motion of the fourth example embodiment of a balance tilt board, according to the techniques of the present disclosure.
Figure 19:
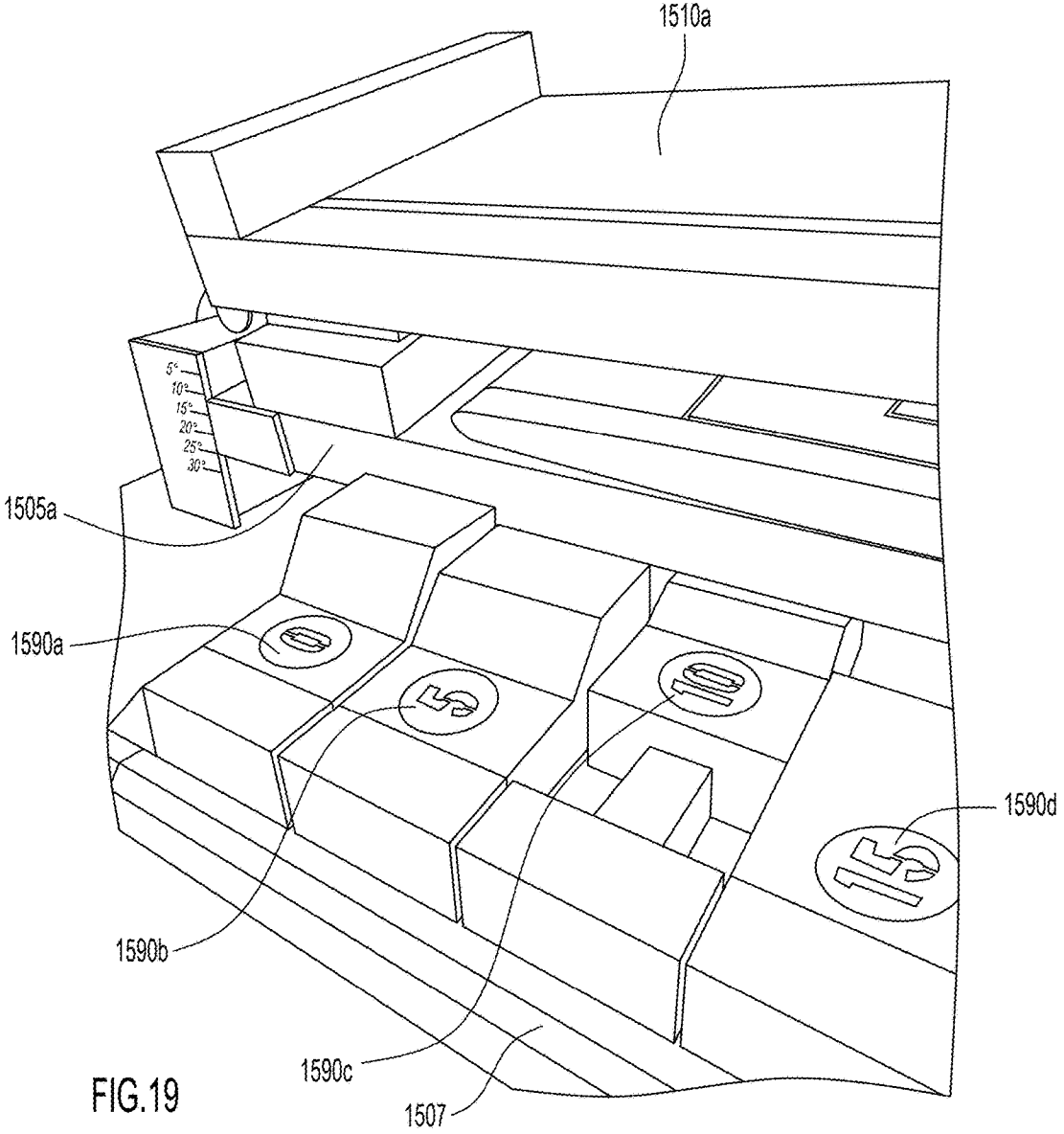
FIG. 19 is a second illustration of how a rotation mechanism alters the range of motion of the fourth example embodiment of a balance tilt board, according to the techniques of the present disclosure.
Figure 20:
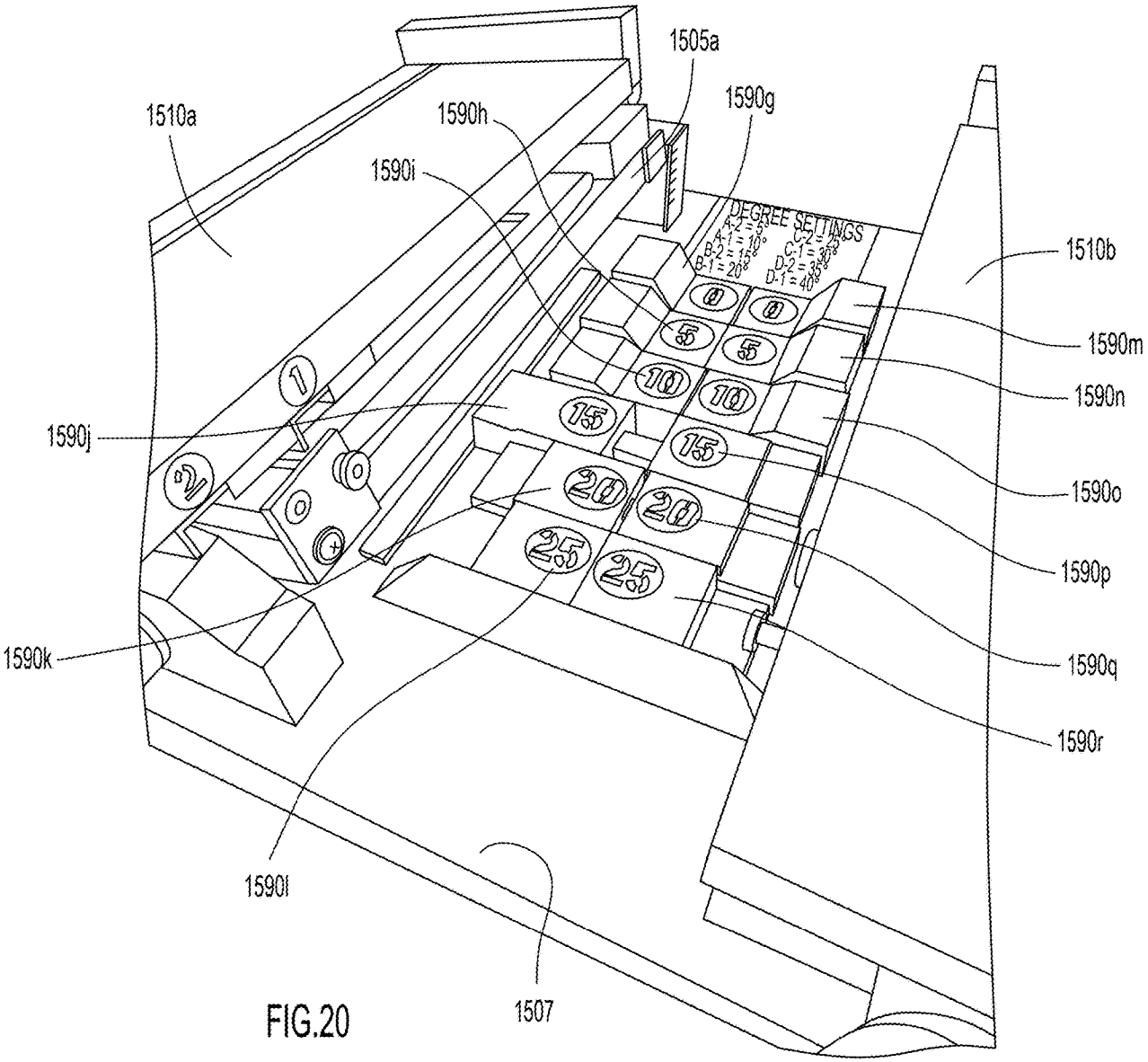
FIG. 20 is a third illustration of how a rotation mechanism alters the range of motion of the fourth example embodiment of a balance tilt board, according to the techniques of the present disclosure.

The construction of balance tilt board 1500 is such that blocks 1590*a-x* set the amount of rotation of foot boards 1510*a* and 1510*b* by sliding under rotating bases 1505*a* and 1505*b*. For example, the amount of rotation permitted to foot board 1510*a* is set by sliding blocks 1590*c* and 1590*j* under rotating base 1505*a*, as shown in FIGS. 18-20. As blocks 1590*c* and 1590*j* are of the same height, the range of motion of rotating base 1505*a* will have the same magnitude on either side of fulcrum 1550*a*. If blocks of different heights, such as blocks 1590*a* and 15901 were slid under rotating base 1505*a*, the range of motion of rotating base 1505*a* will have a different magnitude on either side of fulcrum 1550*a*.

The range of motion of rotating base 1505*b* may be set in an analogous way using blocks 1590*n-x*.

While balance tilt board 1500 is constructed such that the incline of foot boards 1510*a*/1510*b* and the rotation of rotating bases 1505*a*/1505*b* are set using mechanisms similar to balance tilt board 600 of FIGS. 6-11, the skilled artisan would understand that balance tilt board 1500 could be constructed such that the incline of foot boards 1510*a*/1510*b* and the rotation of rotating bases 1505*a*/1505*b* are set using mechanisms similar to balance tilt board 1200 of FIGS. 12-14.

Benefits of balance tilt board 1500 may include:

Independent motion for left and right sides of a user.

Defined angles for movement with a chart setting guide.

Rotation for each foot of, for example, 15 degrees inward and outward.

A letter & number combination guide to facilitate the setting of the incline and rotation angles in set increments.

A truss rod system to handle over 350 pounds of continuous load.

A colored and numbered sliding block system to limit rotation side to side in set increments.

Indicators on inclination and rotation to verify angles of settings.

A heavy-duty construction using Oak, Aluminum, Steel. Stainless Steel, Corrosion Resistant Steel, 3D printed composites, and others known to the skilled artisan.

A color-coded system for quick verification of settings.

Contact friction beds to prevent slipping.

Figure 15:
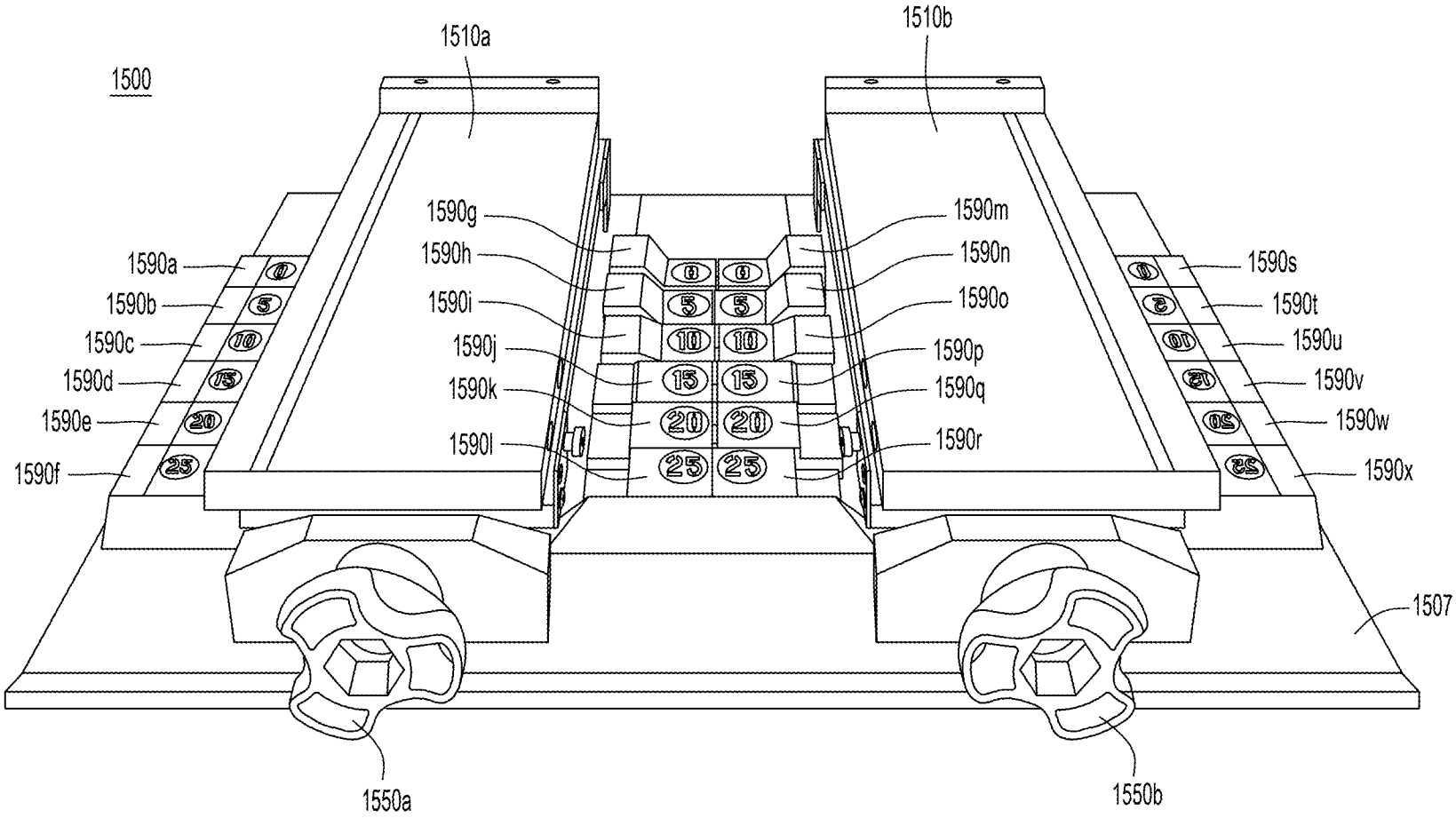
FIG. 15 is a first illustration of a fourth example embodiment of a balance tilt board, according to the techniques of the present disclosure.

A fot bed heel catch to prevent slipping off the back the unit (see FIG. 15).

A bright visual line to help with initial body alignment per foot when stepping on the unit.

In summary, provided for herein is an apparatus including: at least one foot board settable to one or more predetermined inclination angles; at least one rotating base rotatable through one or more predetermined ranges of rotation; and a stationary base, wherein the stationary base supports the at least one foot board and the at least one rotating base such that a user placing a foot on the at least one foot board can flex or extend the foot at the one or more predetermined inclination angles and can pronate or supinate the foot through the one or more predetermined ranges of rotation.

In some aspects, the techniques described herein relate to an apparatus, further including one or more supports arranged between the at least one foot board and the at least one rotating base, wherein the one or more supports incline the at least one foot board relative to the at least one rotating base at the one or more predetermined inclination angles.

In some aspects, the techniques described herein relate to an apparatus, wherein the one or more supports secure the at least one foot board at the one more inclination angles by engaging one or more gussets arranged on the at least one foot board.

In some aspects, the techniques described herein relate to an apparatus, wherein the one or more supports secure the at least one foot board at the one more inclination angles via a rod that engages a first gusset arranged on the at least one foot board, passes through an orifice arranged in the one or more supports, and engages a second gusset arranged on the at least one foot board.

In some aspects, the techniques described herein relate to an apparatus, further including one or more blocks, wherein the one or more blocks are configured to be selectively placed between the at least one rotating base and the stationary base to set the one or more predetermined ranges of rotation.

In some aspects, the techniques described herein relate to an apparatus, further including one or more rods, wherein the one or more rods are configured to pass through an orifice in a first support plate secured to the stationary base and engage with a notch or hole in a second support plate secured to the at least one rotating base to set the one or more predetermined ranges of rotation.

In some aspects, the techniques described herein relate to an apparatus, further including a rod providing an axis or rotation about which the at least one rotating base rotates through the one or more predetermined ranges of rotation, wherein the rod passes through a first orifice in a first support secured to the stationary base and passes through a second orifice in a second support secured to the rotatable base.

In some aspects, the techniques described herein relate to an apparatus including: at least one foot board settable to one or more predetermined inclination angles; and a stationary base, wherein the stationary base supports the at least one foot board such that a user placing a foot on the at least one foot board can flex or extend the foot at the one or more predetermined inclination angles.

In some aspects, the techniques described herein relate to an apparatus, further including one or more supports arranged between the at least one foot board and the stationary base, wherein the one or more supports incline the at least one foot board relative to the stationary base at the one or more predetermined inclination angles.

In some aspects, the techniques described herein relate to an apparatus, wherein the one or more supports secure the at least one foot board at the one more inclination angles by engaging one or more gussets arranged on the at least one foot board.

In some aspects, the techniques described herein relate to an apparatus, wherein the one or more supports secure the at least one foot board at the one more inclination angles via a rod that engages a first gusset arranged on the at least one foot board, passes through an orifice arranged in the one or more supports, and engages a second gusset arranged on the at least one foot board.

The above description is intended by way of example only.

What is claimed is:

1. An apparatus comprising:

a stationary base;

at least one rotating base mounted to the stationary base via a fulcrum having a horizontal axis, the at least one rotating base rotatable through a plurality of predetermined ranges of rotation about the horizontal axis;

at least one foot board hingedly connected to the at least one rotating base and settable to a plurality of predetermined inclination angles relative to the at least one rotating base;

a plurality of blocks having different heights, slidably arranged on the stationary base, wherein the plurality of blocks are independently slidable along the stationary base and under the at least one rotating base to set the plurality of predetermined ranges of rotation of the at least one rotating base about the horizontal axis of the fulcrum, and a plurality of supports having different heights, rotatably arranged on the at least one rotating base, wherein the plurality of supports are independently rotatable to engage the at least one foot board to set the at least one foot board at the plurality of predetermined inclination angles, wherein the stationary base supports the at least one foot board and the at least one rotating base such that a user placing a foot on the at least one foot board can flex or extend the foot at the plurality of predetermined inclination angles and can pronate or supinate the foot through the plurality of predetermined ranges of rotation.

2. The apparatus of claim 1, further comprising one or more gussets arranged under the at least one foot board, wherein the plurality of supports independently engage a gusset of the one or more gussets to set the at least one foot board at the plurality of predetermined inclination angles.

3. The apparatus of claim 1, wherein the fulcrum comprises a rod, and wherein the rod passes through a first orifice in a stationary base support secured to the stationary base and passes through a second orifice in a rotating base support secured to the at least one rotating base.

4. The apparatus of claim 1, wherein the plurality of supports are rotatably arranged on the at least one rotating base in a nested arrangement.

* * * * *